US005147984A

United States Patent [19]

Mazeika et al.

[11] Patent Number: 5,147,984

[45] Date of Patent: Sep. 15, 1992

[54] CAP AND PIN INSULATOR

[75] Inventors: Linas Mazeika; John A. Midgley, both of San Carlos, Calif.

[73] Assignee: Raychem Corporation, Menlo Park, Calif.

[21] Appl. No.: 622,044

[22] Filed: Dec. 4, 1990

[51] Int. Cl.[5] ..... H01B 17/06

[52] U.S. Cl. ..... 174/182

[58] Field of Search ..... 174/141 R, 150, 178, 174/182, 188, 189, 195, 196, 209, 210, 211, 212; 29/631

[56] References Cited

U.S. PATENT DOCUMENTS

| | | | |
|---|---|---|---|
| 3,192,312 | 6/1965 | Sauer | 174/211 X |
| 4,267,403 | 5/1981 | Pargamin | 174/179 X |
| 4,331,833 | 5/1982 | Pargamin et al. | 174/179 |
| 4,399,064 | 8/1983 | Penneck | 174/110 EX |
| 4,427,843 | 1/1984 | Ishihara et al. | 174/179 X |
| 4,443,659 | 4/1984 | Tatem | 174/182 X |
| 4,604,498 | 8/1986 | Kuhl | 174/179 X |
| 4,689,445 | 8/1987 | Seike et al. | 174/182 X |
| 4,724,284 | 2/1988 | Wheeler | 174/179 X |
| 4,845,318 | 7/1989 | Clabburn et al. | 174/178 |

FOREIGN PATENT DOCUMENTS

| | | | |
|---|---|---|---|
| WO90/03955 | 4/1990 | PCT Int'l Appl. . | |
| 1209690 | 10/1970 | United Kingdom | 174/212 |
| 1292276 | 10/1972 | United Kingdom . | |
| 1313609 | 4/1973 | United Kingdom . | |

OTHER PUBLICATIONS

"Silane Coupling Agent Chemistry", by Barry Arkles.

"The Chemistry of Titanate Coupling Agents" pp. 2-34.

"Properties of Copper to Epoxy Impregnated Synthetic Paper Prepreg" (Shin-Kobe Electric Machinery Co., Ltd.-JP 81 28,222).

"Zirconate Coupling Agents", pp. 7, 20.

*Primary Examiner*—Leo P. Picard

*Assistant Examiner*—T. Korka

*Attorney, Agent, or Firm*—Herbert G. Burkard; William D. Zahrt, II; A. Stephen Zavell

[57] ABSTRACT

An insulator member comprises a porcelain insulator head and a polymeric shed secured to the insulator head. The insulator member can be used, for example, in an improved electrical line insulator which comprises a) an insulator unit comprising a porcelain head, and a polymeric shed secured to the porcelain head; b) a metal cap and a metal pin each situated at a surface of the insulator unit opposite to the other, the porcelain head forming a recess to receive the pin; c) cement mechanically securing the cap to the insulator unit; and d) cement within the recess and about the pin mechanically securing the pin within the recess. Methods of manufacture are also disclosed.

36 Claims, 5 Drawing Sheets

CAP AND PIN INSULATOR

FIELD OF THE INVENTION

This invention relates to high-voltage electric line insulators, specifically suspension insulators of the cap-and-pin type.

BACKGROUND OF THE INVENTION

Electrical insulators commonly known as suspension insulators can be used individually, but usually form part of a string to support an electrical conductor from a supporting structure. Generally such a suspension insulator comprises two metal hardware members secured to opposite surfaces of a suitably contoured porcelain insulator shell, one hardware member being embedded by means of cement in a cavity in the porcelain insulator shell. The hardware members, typically an upper cap and a lower pin, are each secured by a layer of cement or other suitable material. By this arrangement the metal hardware members are separated and insulated from each other. This traditional combination of metal, porcelain and cement yields a heavy unit, generally weighing eight to thirty pounds.

Prior art suspension insulators, which include a one-piece ceramic head and shed, are easy to break during manufacture, transport, or installation. During operation the insulators suffer from vandalism, especially in those areas in which hunting is prevalent. U.S. Pat. No. 4,689,445 shows a cap-and-pin insulator which has a ceramic shed with a designed failure mode. The ceramic shed is made to fracture along specific fault lines, so as to maintain the insulation properties of the linked unit.

Glass or porcelain line insulators are at risk for surface arcing phenomenon, especially in highly polluted or coastal areas. This phenomenon is related to a damp layer of conductive polluting substance on the surface of the insulator. Leakage current dries the layer in some high-current density zones, and conditions promote the generation of electric arcs which short-circuit the dry zones. Numerous solutions have been proposed to mitigate the surface arcing phenomenon. They are generally based on the principle of providing a semiconductor zone between two electrodes so as to modify the distribution of the electric field in such a way as to make it less favorable to the generation of surface arcs.

In polluted areas there is an additional problem encountered in the region of the metal pin. Due to the action of the pollution and the leakage current which flows through the metal cap and pin, a corrosion takes place. This can lead to part failure in the metal pin, and cause the line to drop.

Because the prior art has not found an adequate solution to the surface arcing problem and the corrosion of the metal pin, there is a need to wash or clean the surface of line insulators in coastal or polluted areas. This is a process which requires the use of specialized equipment and trained staff, and includes a risk of breakage of the ceramic sheds.

It would be desirable to provide a cap-and-pin type insulation unit which is lighter than those of the prior art, resists the electrical surface phenomena associated with the prior art, and provides improved mechanical properties, while providing excellent insulation properties.

OBJECTS OF THE INVENTION

It is therefore an object of the invention to provide a line insulator which provides improved resistance to surface arcing phenomenon.

It is another object of the invention to provide a line insulator which is relatively lightweight.

It is another object of the invention to provide a line insulator which is resistant to breakage.

It is yet another object of the invention to provide a line insulator which is simple in design and relatively easy to manufacture.

It is an object of this invention to provide methods to accomplish the foregoing.

These and other objects will be apparent from the following description and the claims appended hereto.

SUMMARY OF THE INVENTION

An improved electrical line insulator comprises a) an insulator unit comprising a porcelain head and a polymeric shed secured to the porcelain head; b) a metal cap and a metal pin each situated at a surface of the insulator unit opposite to the other, the porcelain head forming a recess to receive the pin; c) securing means mechanically securing the cap to the insulator unit; and d) pin insertion means within the recess and about the pin mechanically securing the pin within the recess.

A method of manufacturing an improved electrical line insulator comprises a) securing a metal cap to a porcelain-polymer hybrid insulator, and b) securing a metal pin within a recess of the porcelain-polymer hybrid insulator, wherein said porcelain-polymer hybrid insulator comprises a porcelain insulator head and a polymeric shed secured to the insulator head.

An improved insulator member comprises a porcelain head and an insulating polymeric shed secured to the porcelain head.

A method of manufacturing an improved insulator member comprises a) providing a porcelain head, and b) securing an insulating polymeric shed to the porcelain head.

DESCRIPTION OF THE INVENTION INCLUDING BEST MODE

A cap-and-pin electrical insulator with improved insulation, breakage and weight parameters is disclosed. Cap-and-pin insulators are generally used in the transmission of electricity in the 15 kV to 735 kV range. The insulators are commonly used in series, that is, more than one insulator unit is provided, and the insulator units are joined to one another to provide a string of insulating units.

The improved insulating units herein include a porcelain head portion, and a polymeric shed portion comprising an electrically insulating, preferably non-tracking, polymeric material.

Porcelain is a preferred insulating material in some applications because of its superior resistance to damage by electrical discharges, to weathering, and to chemical attack. It is not an expensive material to manufacture into an insulator. However, it is relatively heavy, and is a brittle material which can shatter on impact. The convolutions or sheds of the prior art are particularly vulnerable. Furthermore, porcelain has a high surface free energy, which makes it retentive of dirt. Its manufacturing process requires firing in a kiln, and this is not conducive to the easy manufacture of complex shapes.

The use of a polymeric shed in combination with a porcelain head provides a variety of advantages over the prior art. The improved units provide an appreciable reduction of weight when contrasted to the prior art. The polymeric shed is significantly less subject to breakage in manufacture, shipping, use, and cleaning. The polymeric shed is not subject to fracture from vandalism and, if damaged, provides an improved insulator when contrasted to a similar porcelain shed. The porcelain head portion is largely enclosed within the metal cap or covered by the polymeric shed, so that it is protected from damage.

The polymeric shed portion has at least one external shed, and an inner surface of predetermined normal configuration and diameter. The polymeric shed can be molded in place, it can be adhered to the porcelain head using a high-voltage mastic or known bonding agents, or, preferably, a combination of methods can be used.

Similar numbers refer to similar function throughout the figures. The figures are drawn for clarity and are not drawn to scale.

Figure 1:
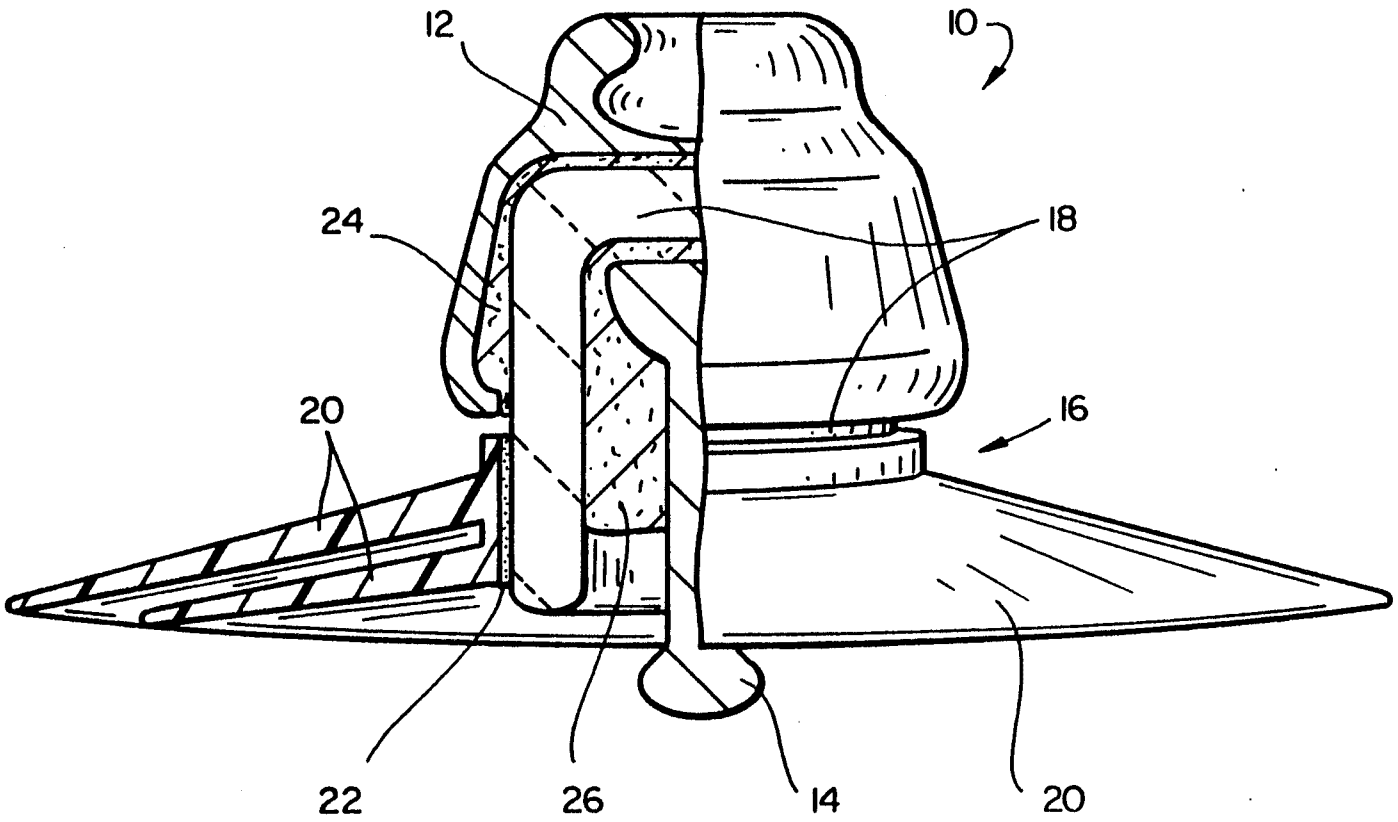
FIG. 1 is a partially sectioned elevational view of a cap-and-pin type line insulator according to the present invention.

FIG. 1 shows a cap-and-pin type insulator unit, 10. The insulator unit comprises a metal cap 12, a metal pin 14, and an insulator core 16, comprising a porcelain head 18 portion and a polymeric shed 20 portion. The porcelain head 18 and the polymeric shed 20 are joined with an adhesive layer 22. The metal cap 12 and the porcelain head 18 are joined with a cap securing means 24. The metal pin 14 and the porcelain head 18 are joined with a pin securing means 26.

When assembled in a series, the metal cap 12 is attached to the pin of the insulator unit above it, and the metal pin 14 is attached to the cap of the insulator unit beneath it. Suitable cap and pin assemblies are well known in the art. Conveniently the cap is manufactured from cast iron, and the pin is made of steel. For convenience, the cap and pin are preferably configured in conformance with industry standards, so that a unit of this invention can easily replace a worn or broken unit in the field. It is an advantage of the present invention that the metal cap 12 and the metal pin 14 support less weight than was necessary in the prior art, and can therefore be made more lightweight than was possible in the prior art.

The insulator core 16 comprises a porcelain head 18 portion and a polymeric shed 20 portion which are adhered at or near the periphery of the porcelain head 18.

The porcelain head 18 can comprise, for example, porcelain or other ceramic material, a glass or other vitreous material, or other materials presently used as electrical insulation material in high voltage insulators. It is to be understood that the term "porcelain" is used for convenience of terminology, and is intended to include these alternate materials.

In a preferred embodiment, the porcelain head 18 is a metal oxide dielectric dense body as described in PCT WO90/03955, the disclosure of which is incorporated herein by reference. These ceramics can be fired at relatively low temperatures, thereby simplifying the manufacturing process. The ceramics also exhibit good mechanical properties. Especially preferred are porcelain heads made of mullite, mullite-silica, or silica.

Figure 2:
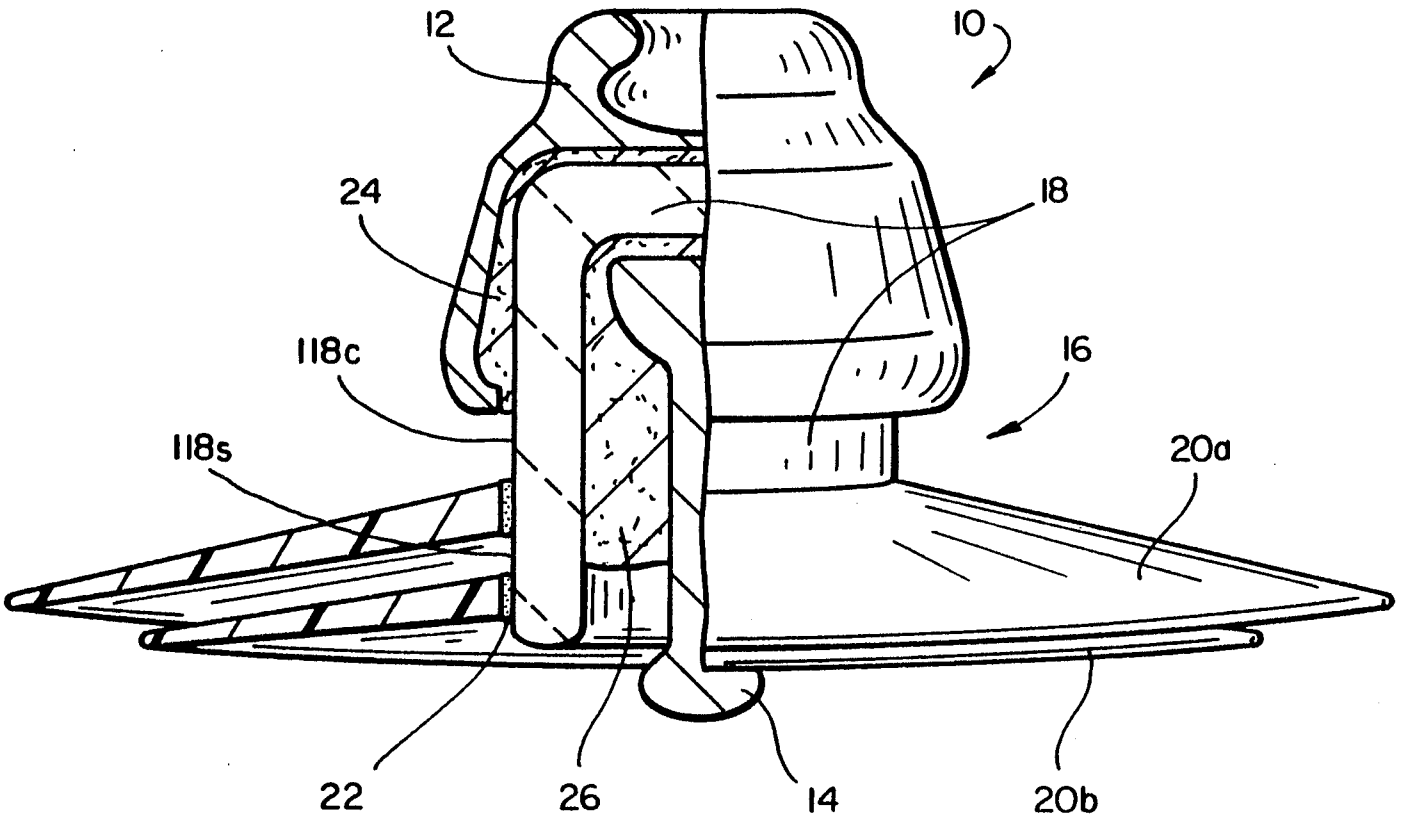
FIGS. 2–4 are views similar to FIG. 1 of additional embodiments of the present invention.
Figure 3:
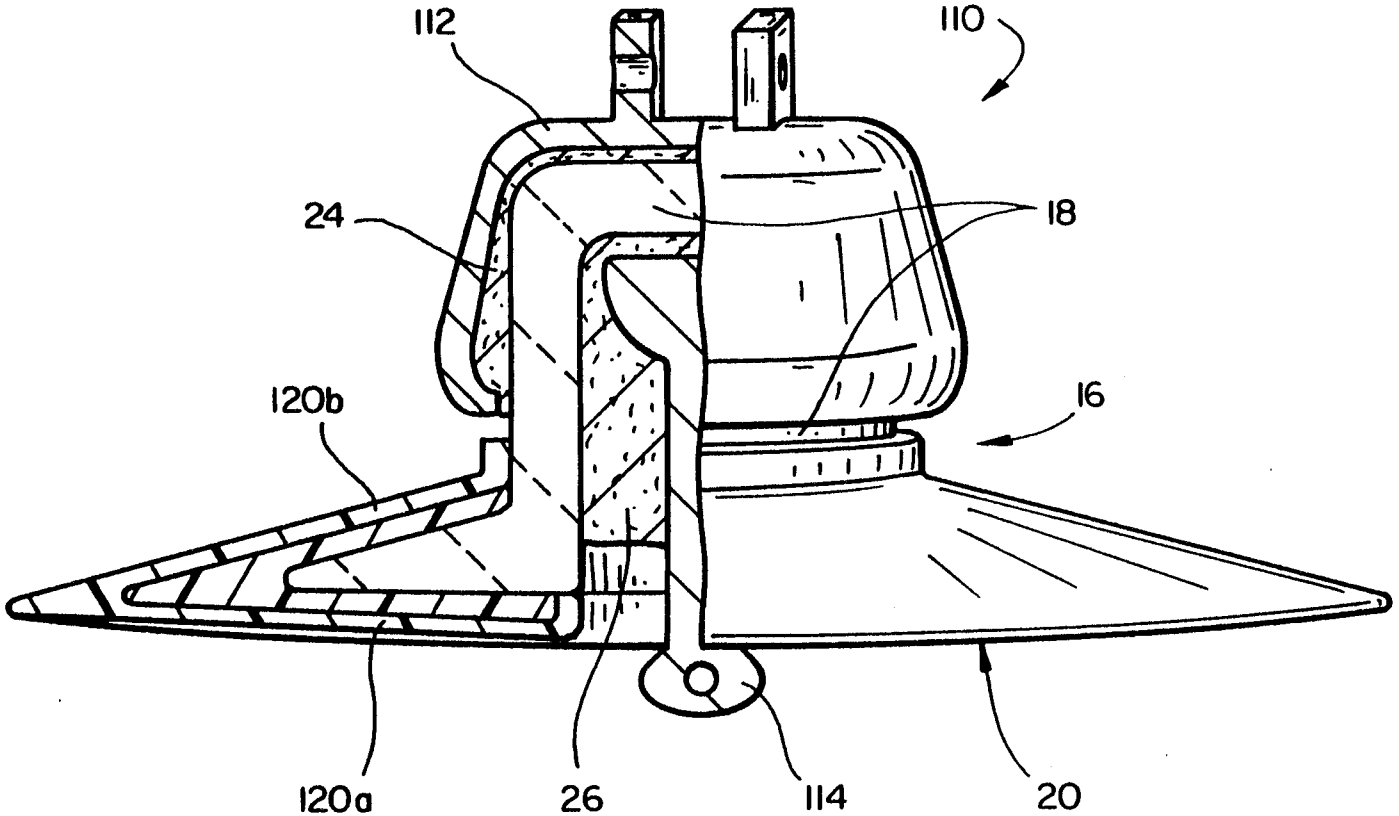

The porcelain head 18 is generally a cup-shaped member. The specific configuration of the porcelain head can be varied as desired. For example, the walls of the "cup" can be extended as desired to provide a platform for the adhesion of the polymeric shed. As shown in FIG. 1, the porcelain head can have straight sides, ending in a flattened or curved lip. Alternate embodiments of the porcelain head portion are shown in FIGS. 2 and 3.

The adhesive layer 22 forms a bond between the porcelain head 18 and the polymeric shed 20. The adhesive can be any of several known adhesive compounds. Preferably the adhesive causes a permanent bond, and adheres to both the porcelain material of the porcelain head 18 and to the polymeric material of the polymeric shed 20. Known high voltage mastics can be used. The adhesive is preferably a member of one of three families: the silane coupling agents, the organic titanate coupling agents, and the organic zirconate coupling agents.

The polymeric shed 20 generally includes at least one fin element. If two or more fins are present, they can be substantially the same, or they can be different in shape or in composition. For purposes of example only, and not as a limitation, reference will be made to sheds which are single-fin units. It is to be understood that this is for simplicity of example only, and that the constructions, methods and teachings will be similarly applicable to a variety of fin embodiments including two-fin or multiple-fin arrangements.

The insulating polymeric compound of the arrangement, which advantageously is electrically substantially non-tracking, should desirably have good weather resistant properties when it is to be used outdoors, and may comprise a thermoplastic material, which may or may not be cross-linked, a thermoset material, or an elastomeric material. The polymeric shed is generally comprised of one or more anti-tracking high voltage insulating materials, such as those described in U.S. Pat. Nos. 4,399,064 and 4,521,549, the disclosure of each of which is incorporated herein by reference. The polymeric shed is preferably a polyolefin or other olefin polymer, obtained from two or more monomers, especially terpolymers, polyacrylates, silicone polymers and epoxides, especially cycloaliphatic epoxides. Among epoxide resins of the cycloaliphatic type there may be especially mentioned those sold commercially by CIBA (A.R.L.) limited under the names CY 185 and CY 183. Particularly suitable polymers include polyethylene, ethylene/ethyl acrylate copolymers, ethylene/vinyl acetate copolymers, ethylene/propylene copolymers, ethylene/propylene non-conjugated-diene terpolymers, chlorosulphonated polyethylene, polypropylene, polydimethyl siloxane, dimethyl siloxane/methyl vinyl siloxane copolymers, fluoro silicones, e.g., those derived from 3,3,3-trifluoropropyl siloxane, carborane siloxanes, e.g. "Dexsil" polymers made by Olin Mathieson, polybutyl acrylate/acrylonitrile copolymers, butyl acrylate/acrylonitrile copolymers, butyl acrylate/-glycidyl methacrylate copolymers, polybutene, butyl rubbers, ionometric polymers, e.g. "Surlyn" materials sold by DuPont, or mixtures of any two or more of the above. More preferably the polymeric shed is an ethylene/vinyl acetate copolymer.

The polymeric shed 20 can be moulded or push-fitted onto the porcelain head 18. An adhesive layer 22, as described above, which will bond to both the porcelain head 18 and the polymeric shed 20 is present.

Alternatively, the polymeric shed can be recovered (for example, by heat) onto the porcelain head 18. A recoverable article is an article the dimensional configuration of which can be made to change when subjected to an appropriate treatment. The article can be heat-recoverable such that the dimensional configuration can be made to change when subjected to a heat treatment. Usually these articles recover, on heating, towards an original shape from which they have previously been deformed, but the term "heat recoverable", as used herein, also includes an article which, on heating, adopts a new configuration, even if it has not been previously deformed. In their most common form, such articles comprise a heat-shrinkable sleeve made from a polymeric material exhibiting the property of elastic or plastic memory as described, for example, in U.S. Pat. Nos. 3,086,242 and 3,597,372. High voltage heat-shrinkable polymers are described in U.S. Pat. Nos. 4,399,064 and 4,521,549.

The original dimensionally heat-stable form can be a transient form in a continuous process in which, for example, an extruded tube is expanded, while hot, to a dimensionally heat-unstable form. In other applications, a preformed dimensionally heat stable article is deformed to a dimensionally heat unstable form in a separate stage. The polymeric material can be cross-linked at any stage in its production that will enhance the desired dimensional recoverability. One manner of producing a heat-recoverable article comprises shaping the polymeric material into the desired heat-stable form, subsequently cross-linking the polymeric material, heating the article to a temperature above the crystalline melting point or, for amorphous materials, the softening point, as the case may be, of the polymer, deforming the article and cooling the article while in the deformed state so that the deformed state of the article is retained. In use, since the deformed state of the article is heat-unstable, application of heat will cause the article to assume its original heat-stable shape. In other articles, as described for example in British Pat. 1,440,524, an elastomeric member such as an outer tubular member is held in a stretched state by a second member, such as an inner tubular member. Upon heating, the inner tubular member weakens and allows the elastomeric member to recover.

The metal cap 12 and the porcelain head 18 are joined with a cap securing means 24. The metal pin 14 and the porcelain head 18 are joined with a pin securing means 26. The cap securing means 24 and the pin securing means 26 can be the same, or they can be different. Both are preferably neat Portland cement. However, either or both can be a high dielectric strength cement or polymer concrete. Such securing means are well known in the art.

FIG. 2 shows a cap-and-pin type insulator unit, 10. The insulator unit comprises a metal cap 12, a metal pin 14, and an insulator core 16, comprising a porcelain head 18 portion and two polymeric sheds, 20*a* and 20*b*. The two polymeric sheds 20*a* and 20*b* are located on the outer edge of the porcelain head 18 such that areas of the porcelain head 18 are exposed.

In polluted conditions, two types of electrical discharge activity will take place on the surface of an insulator. The first type takes place randomly over the entire surface area, and, although the surface is eroded, this activity is not very intense and generally does not seriously damage the insulation. The polymeric sheds used herein preferably comprise a shed made of an anti-tracking high voltage insulating material such as that of U.S. Pat. Nos. 4,399,064 and 4,521,549, the disclosure of each of which is incorporated by reference. This polymeric shed is less subject to fouling in coastal or polluted regions than porcelain sheds.

The second type of activity is sparking which becomes rooted or anchored, for example at a boundary of the insulation with a metal fitting or beneath a shed, and thus takes place preferentially over a particular portion of the insulating surfaces. This latter activity is more intense than the former, and is often the limiting factor in the lifetime of the insulator.

To combat this sparking, the porcelain head 18 is exposed between the metal cap 12 and the first polymeric shed 20*a*, at region 118*c*. This configuration prevents sparking, which can occur in the immediate vicinity of metal (such as the metal cap 12), from damaging the polymeric shed. Instead, the spark is directed primarily onto the surface of the porcelain head 18, and not onto the surface of the more vulnerable polymeric shed. As shown in FIG. 2, a portion of the porcelain head 18 between polymeric sheds, 20*a* and 20*b* can also be exposed, such as shown at 118*s*. The advantages of an exposed porcelain surface are discussed in U.S. Pat. No. 4,845,318, which is incorporated herein by reference.

FIG. 3 shows an alternate configuration of the cap-and-pin type insulator unit, 110. The metal cap 112 and a metal pin 114 of adjoining units are connected with a cotter pin (not shown) to link units.

The insulator core 16 comprises a porcelain head 18 and a polymeric shed 20. As shown, the porcelain head 18 can be extended at its rim portion to provide an extended surface area for the attachment of the polymeric shed 20. In alternate embodiments, not shown, the rim of the porcelain head 18 exhibits additional ridges, rims, variations, and the like, to increase the surface area to which the polymeric shed 20 can be attached.

As shown, the porcelain head 18 and the polymeric shed 20 can be joined by molding the polymeric shed around the porcelain head 18, without the use of an adhesive. Preferably, however, an adhesive is used.

The polymeric shed 20 can comprise more than one layer of polymer. A polymer 120*b* which is not substantially non-tracking can be covered with a polymer 120*a* which is substantially non-tracking, as shown, to form the polymeric shed 20. This provides a non-tracking surface for the polymeric shed 20, while permitting the use of less expensive insulating polymers in non-critical areas.

Figure 4:
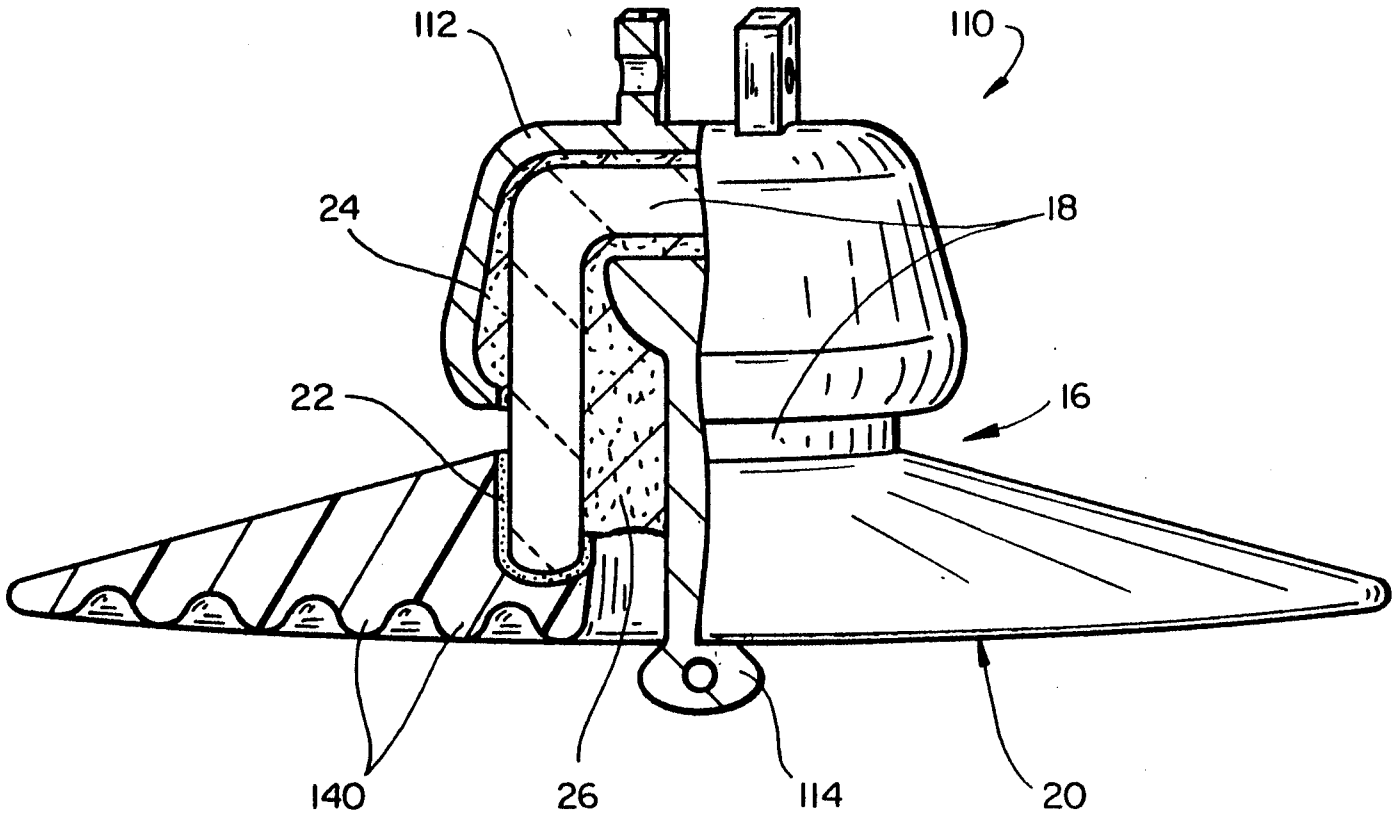

FIG. 4 shows a configuration of the cap-and-pin type insulator unit, 110, which is preferable for use in areas which are subject to fog. The metal cap 112 and a metal pin 114 of adjoining units are connected with a cotter pin (not shown) to link units. The insulator core 16 comprises a porcelain head 18 and a polymeric shed 20, joined by an adhesive layer 22.

The polymeric shed 20 can include ridges 140. In this embodiment, the polymeric shed includes circular ridges such as are well known in the art for the design of ceramic sheds.

Figure 5:
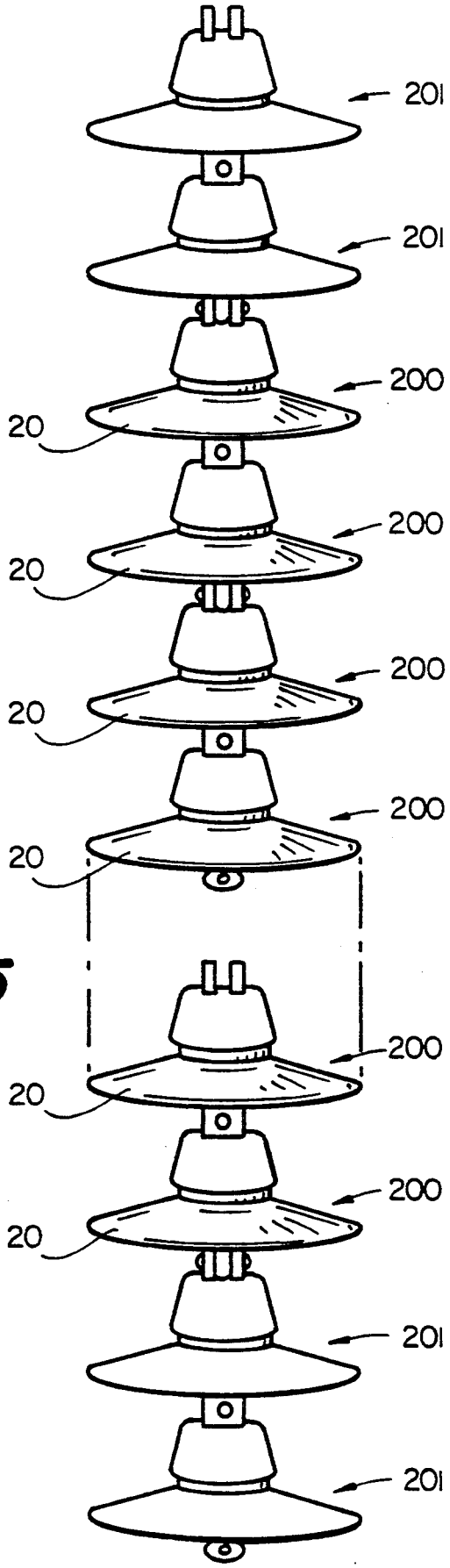
FIG. 5 is a somewhat figurative elevational view illustrating a "string" of insulator units.

FIG. 5 shows a string of the polymeric shed cap-and-pin insulators 200 in combination with standard ceramic shed cap-and-pin insulators 201. Such a combination of units may be preferred when the insulators are used in combination with power lines in which the transmission is greater than about 275 kV.

The following examples illustrate the invention:

EXAMPLE 1

Mullite-Silica Head Portion

A bismuth stock solution is prepared by dissolving bismuth nitrate pentahydrate ($Bi(No_3)_3 \cdot 5H_2O$), 5.82 Kg) in concentrated nitric acid (3.84 L) and then diluting with water to a final volume of 40 L.

A 3 gallon mill jar is charged with 300 burundum cylinders (13/16×13/16), clay (1.25 Kg, 46.8 atom % Si and 48.2 atom % Al), and 3 L deionized water. The mixture is ball-milled for 72 hours, after which the clay-water slurry is transferred and diluted with water to a volume of 10 L, giving a slurry composition of 1.25 Kg clay/L slurry.

10 L of the clay slurry is added to a vessel. 10 L deionized water, and 2 L concentrated ammonium hydroxide is added. The mixture is homogenized 15 minutes. Finally, 3.322 L of the bismuth stock solution (5.0 atom % Bi) is added to the mixture, which results in the precipitation of the bismuth species onto the clay. The resultant is homogenized for 10 minutes to yield a precursor material.

The precursor material is collected by suction filtration and dried at 140° C. The dried powder is subsequently calcined to remove residual ammonium nitrate by heating according to the following schedule: 4.5 hr at 30°-300° C., then 1 hr at 300° C.

The calcined power is ground, sieved with a <106 micron mesh, and 1.22 Kg of the powder is uniaxially pressed at 10,000 psi into a cupped head mold, and fired for 1.5 hr. at 30°-1,100° C., then 12 hr. at 1,100° C.

EXAMPLE 2

Silica Head Portion

A bismuth stock solution is prepared by dissolving bismuth nitrate pentahydrate ($Bi(No_3)_3 \cdot 5H_2O$), 5.82 Kg) in concentrated nitric acid (3.84 L) and then diluting with water to a final volume of 40 L.

A vessel is charged with colloidal silica (7.521 Kg, 95.7 atom % Si), 2 L deionized water, and 500 mL concentrated ammonium hydroxide. The mixture is homogenized for 5 min. To this mixture is added 7.5 L of the above bismuth stock solution (4.3 atom % Bi), which results in the precipitation of the bismuth species onto the silica. The mixture is then homogenized for 10 minutes to obtain a precursor material.

The precursor material is collected by suction filtration and dried at 140° C. The dried powder is subsequently calcined to remove residual ammonium nitrate by heating according to the following schedule: 4.5 hr at 30°-300° C., then 1 hr at 300° C.

The calcined power is ground, sieved with a <106 micron mesh, and 1.22 Kg of the material is uniaxially pressed at 10,000 psi into a cupped head mold, and fired for 1.5 hr. at 30°-1,100° C., then 12 hr. at 1,100° C.

EXAMPLE 3

Mullite Head Portion

A bismuth stock solution is prepared by dissolving bismuth nitrate pentahydrate ($Bi(No_3)_3 \cdot 5H_2O$), 1.96 Kg) in concentrated nitric acid (1.28 L) and then diluting with water to a final volume of 40 L.

Aluminum nitrate nonahydrate (110.4 g, 67.5 atom % Al) is dissolved in 0.2N nitric acid (1 L). To this solution is added colloidal silica (14.7 g, 22.5 atom % Si) and 436 mL of the above bismuth stock solution (10 atom % Bi). Concentrated aqueous ammonium hydroxide (2 L) is added to precipitate the precursor material, which is is collected by suction filtration and dried at 140° C. The dried powder is ground, sieved with a <106 micron mesh, and 1.22 Kg of the material is uniaxially pressed at 25,000 psi into a cupped head mold, and fired for 2 hr. at 1,000° C.

EXAMPLE 4

Non-Tracking Polymer

A formulation is made as follows, with parts determined by weight. The following materials are mixed in the order given: 30 parts dimethyl silicone elastomer (containing a small amount of methyl vinyl siloxane); 30 parts low density polyethylene; 30 parts ethylene ethyl acrylate; 30 parts alumina trihydrate having a surface area of 16.0 $m^2/g$; 2 parts polymerized trihydroquinaline oxidant; 5 parts calcined ferric oxide; 1 part triallyl cyanurate; and 1 part 2,5-dimethyl 2,5-di-t-butyl peroxy hexyne-3.

EXAMPLE 6

Manufacture of Device 97 mL of Portland cement is poured into a lightweight cast iron cap member. A head portion according to Example 1 is positioned into the wet cement, and the cement is allowed to set. 43 mL of Portland cement is poured into the head portion, and a steel pin is positioned within the head portion. The cement is allowed to set, and the head structure is tested for mechanical strength.

The exposed outer surface of the porcelain head is treated with a silane coupling agent according to manufacturer's directions. A polymer according to Example 4 is injection molded in a shed mold into which the head structure has been positioned, and the polymer is heated at 190° C. for 15 minutes. The insulator unit is tested for electrical properties.

EXAMPLE 7

Alternate Devices

The process of Example 6 is repeated, substituting the porcelain head of Example 2 or Example 3 for the porcelain head of Example 1.

The processes of Examples 6 and 7 are repeated, substituting a mastic, a titanate coupling agent, or a zirconate coupling agent for the silane coupling agent.

EXAMPLE 8

Manufacture of Device

An outer surface portion of a porcelain head of Example 1 is treated with a silane coupling agent according to manufacturer's directions. A polymer according to Example 4 is injection molded in a shed mold into which the head structure has been positioned, and the polymer is heated at 190° C. for 15 minutes. The unit is tested for electrical properties.

97 mL of Portland cement is poured into a lightweight cast iron cap member. The insulator unit is positioned into the wet cement, and the cement is allowed to set. 43 mL of Portland cement is poured into the head portion of the insulator unit, and a steel pin is positioned within the head portion. The cement is allowed to set, and the structure is tested for mechanical strength.

EXAMPLE 9

Alternate Devices

The process of Example 8 is repeated, substituting the porcelain head of Example 2 or Example 3 for the porcelain head of Example 1.

The processes of Examples 8 and 9 are repeated, substituting a mastic, a titanate coupling agent, or a zirconate coupling agent for the silane coupling agent.

EXAMPLE 10

Manufacture of Device 97 mL of Portland cement is poured into a lightweight cast iron cap member. A head portion according to Example 1 is positioned into the wet cement, and the cement is allowed to set. 43 mL of Portland cement is poured into the head portion, and a steel pin is positioned within the head portion. The cement is allowed to set, and the head structure is tested for mechanical strength.

The exposed outer surface of the porcelain head is treated with a high voltage mastic according to manufacturer's directions.

A polymer according to Example 4 is injection-molded in a shed mold, and the polymer is heated at 190° C. for 15 minutes. After molding, the shed is cooled in water, trimmed, and then heated in a glycerine bath at 170° C. for 3 minutes. A mandrel having a diameter 1.2 times the diameter of the shed is forced through the shed, and then the mandrel plus the shed is cooled in cold water for 5 minutes. The mandrel is then removed. The shed is positioned over the coupling-agent treated porcelain head portion, and the shed is heated with a hot air gun to 170° C. The shed shrinks and completely recovers its original internal diameter. The insulator unit is then tested for electrical properties.

While the invention has been described in connection with specific embodiments thereof, those skilled in the art will recognize that various modifications are possible within the principles described herein. Such modifications, variations, uses, or adaptations of the invention, including such departures from the present disclosure as come within known or customary practice in the art, fall within the scope of the invention and of the appended claims.

We claim:

1. A cap and pin insulator member comprising a porcelain head and at least one polymeric shed secured to the porcelain head, each such shed being composed entirely of an insulating polymeric compound.

2. An insulator member according to claim 1 wherein the porcelain head comprises a metal oxide dielectric dense body.

3. An insulator member according to claim 1 wherein the polymeric shed comprises a non-tracking polymer.

4. An insulator member according to claim 3 wherein the non-tracking poly comprises an ethylene/ethyl acrylate copolymer.

5. An insulator member according to claim 1 wherein the polymeric shed comprises at least one fin.

6. An insulator member according to claim 1 wherein the porcelain head and the polymeric shed are adhered by a mastic or an adhesive interface between the porcelain head and the polymeric shed.

7. An insulator member according to claim 1 wherein the porcelain head and the polymeric shed are adhered using a chemical bonding agent.

8. An insulator member according to claim 7 wherein the chemical bonding agent is selected from the group consisting of silane coupling agents, organic titanate coupling agents, organic zirconate coupling agents, silicone adhesives, epoxy adhesives, and mixtures thereof.

9. An insulator member according to claim 7 wherein the chemical bonding agent is selected from the group consisting of silane coupling agents, organic titanate coupling agents, organic zirconate coupling agents, and mixtures thereof.

10. A method of manufacturing a insulator member comprising a) providing a porcelain head, and b) securing at least one polymeric shed to the porcelain head, each such shed being composed substantially entirely of an insulating polymeric compound.

11. A method according to claim 10 wherein the porcelain head is a metal oxide dielectric dense body.

12. A method according to claim 10 wherein the polymeric shed is a non-tracking polymer.

13. A method according to claim 12 wherein the non-tracking polymer is an ethylene/ethyl acrylate copolymer.

14. A method according to claim 10 wherein the polymeric shed is at least one fin.

15. A method according to claim 10 wherein said securing step further comprises adhering the porcelain head and the polymeric shed by a mastic or an adhesive interface between the porcelain head and the polymeric shed.

16. A method according to claim 10 wherein said securing step further comprises adhering the porcelain head and the polymeric shed using a chemical bonding agent.

17. A method according to claim 16 further comprising selecting the chemical bonding agent from the group consisting of silane coupling agents, organic titanate coupling agents, organic zirconate coupling agents, silicone adhesives, epoxy adhesives, and mixtures thereof.

18. A method according to claim 16 further comprising selecting the chemical bonding agent from the group consisting of silane coupling agents, organic titanate coupling agents, organic zirconate coupling agents, and mixtures thereof.

19. An electrical line insulator comprising a) an insulator unit comprising a porcelain head and at least one polymeric shed secured to the porcelain head, each such shed being composed entirely of an insulating polymeric compound; p1 b) a metal cap and a metal pin each situated at a surface of the insulator unit opposite to the other, the porcelain head forming a recess to receive the pin;

c) securing means mechanically securing the cap to the insulator unit; and d) pin insertion means within the recess and about the pin mechanically securing the pin within the recess.

20. An electrical line insulator according to claim 19 wherein the porcelain head comprises a metal oxide dielectric dense body.

21. An electrical line insulator according to claim 19 wherein the polymeric shed comprises a non-tracking polymer.

22. An electrical line insulator according to claim 21 wherein the non-tracking polymer comprises an ethylene/ethyl acrylate copolymer.

23. An electrical line insulator according to claim 19 wherein the polymeric shed comprises at least one fin.

24. An electrical line insulator according to claim 19 wherein the porcelain head and the polymeric shed are adhered by a mastic or an adhesive interface between the porcelain head and the polymeric shed.

25. An electrical line insulator according to claim 19 wherein the porcelain head and the polymeric shed are adhered using a chemical bonding agent.

26. An electrical line insulator according to claim 25 wherein the chemical bonding agent is selected from the group consisting of silane coupling agents, organic titanate coupling agents, organic zirconate coupling agents, silicone adhesives, epoxy adhesives, and mixtures thereof.

27. An electrical line insulator according to claim 25 wherein the chemical bonding agent is selected from the group consisting of silane coupling agents, organic titanate coupling agents, organic zirconate coupling agents, and mixtures thereof.

28. A method of manufacturing an electrical line insulator comprising a) securing a metal cap to a porcelain-polymer hybrid insulator, and b) securing a metal pin within a recess of the porcelain-polymer hybrid insulator, wherein said porcelain-polymer hybrid insulator comprises a porcelain head and at least one polymeric shed secured to the porcelain head, each such shed being composed entirely of an insulating polymeric compound.

29. A method of claim 28 wherein the porcelain head is a metal oxide dielectric dense body.

30. A method of claim 28 wherein the polymeric shed is a non-tracking polymer.

31. A method of claim 30 wherein the non-tracking polymer is an ethylene/ethyl acrylate copolymer.

32. A method of claim 28 wherein the polymeric shed is at least one fin.

33. A method of claim 28 wherein said securing step further comprises adhering the porcelain head and the polymeric shed by a mastic or an adhesive interface between the porcelain head and the polymeric shed.

34. A method of claim 28 wherein said securing step further comprises adhering the porcelain head and the polymeric shed using a chemical bonding agent.

35. A method according to claim 34 further comprising selecting the chemical bonding agent from the group consisting of silane coupling agents, organic titanate coupling agents, organic zirconate coupling agents, silicone adhesives, epoxy adhesives, and mixtures thereof.

36. A method of claim 34 further comprising selecting the chemical bonding agent from the group consisting of silane coupling agents, organic titanate coupling agents, organic zirconate coupling agents, and mixtures thereof.

* * * * *